US008151505B2

(12) United States Patent
Thompson

(10) Patent No.: US 8,151,505 B2
(45) Date of Patent: Apr. 10, 2012

(54) POWER RAIL SYSTEM

(75) Inventor: John Thompson, Stone Mountain, GA (US)

(73) Assignee: Wolf Pac Technologies Corp., Stone Mountain, GA (US)

( * ) Notice: Subject to any disclaimer, the term of this patent is extended or adjusted under 35 U.S.C. 154(b) by 546 days.

(21) Appl. No.: 11/904,999

(22) Filed: Sep. 28, 2007

(65) Prior Publication Data

US 2011/0000120 A1 Jan. 6, 2011

Related U.S. Application Data

(60) Provisional application No. 60/827,369, filed on Sep. 28, 2006.

(51) Int. Cl.
*F41C 27/00* (2006.01)

(52) U.S. Cl. ..... 42/84; 42/90

(58) Field of Classification Search ..... 42/90, 84, 42/72; 320/112, 113, 114
See application file for complete search history.

(56) References Cited

U.S. PATENT DOCUMENTS 5,103,366 A 4/1992 Battochi
5,142,806 A 9/1992 Swan
5,179,235 A 1/1993 Toole
6,218,043 B1 * 4/2001 Leung et al. ..... 429/99
6,548,205 B2 * 4/2003 Leung et al. ..... 429/99
6,622,416 B2 * 9/2003 Kim ..... 42/146
6,785,997 B2 * 9/2004 Oz ..... 42/94
6,931,775 B2 * 8/2005 Burnett ..... 42/90
7,059,076 B2 * 6/2006 Stoner et al. ..... 42/75.01
7,525,203 B1 * 4/2009 Racho ..... 290/1 R
7,627,975 B1 * 12/2009 Hines ..... 42/84
7,640,690 B2 * 1/2010 Hines ..... 42/84
2001/0002298 A1 * 5/2001 Leung et al. ..... 429/9
2004/0255767 A1 12/2004 Frasca
2005/0252060 A1 * 11/2005 Gonzalez ..... 42/90
2005/0268519 A1 * 12/2005 Pikielny ..... 42/124
2009/0108589 A1 * 4/2009 Racho ..... 42/84
2010/0031552 A1 * 2/2010 Houde-Walter ..... 42/75.03
2010/0192446 A1 * 8/2010 Darian ..... 42/84
2010/0192447 A1 * 8/2010 Cabahug et al. ..... 42/72
2010/0192448 A1 * 8/2010 Darian ..... 42/84

* cited by examiner

*Primary Examiner* — Michael Carone
*Assistant Examiner* — Jonathan C Weber
(74) *Attorney, Agent, or Firm* — Hope Baldauff Hartman, LLC

(57) ABSTRACT

A power supply system for a firearm including a plurality of leads disposed in a rail for providing power to an electric firearm accessory attached thereto and an electric firearm accessory including connectors for electrically connecting to leads disposed in a rail on which the accessory is mounted.

13 Claims, 5 Drawing Sheets

350
380
313
361
363
301
321
200
303
313
323
355
363
385
361

POWER RAIL SYSTEM

RELATED APPLICATIONS

The present United States non-provisional utility patent application is related to, and hereby claims priority to, and the full benefit of, United States provisional patent application entitled Power Rail System, having assigned Ser. No. 60/827,369, filed Sep. 28, 2006 on behalf of John Thompson, incorporated herein by reference.

TECHNICAL FIELD

The present invention relates generally to firearms, and more specifically to a system for providing power to components or devices attached to a firearm.

BACKGROUND OF THE INVENTION

Soldiers, sportsmen, and other firearm users often find it desirable to include one or more accessory(ies) of various kinds on a firearm. Common accessories include sights, scopes, or other aiming devices or enhancements; flashlights, infrared lights, or other illumination devices; or other accessories to meet the needs of user. Many of these, as well as other accessories for firearms, require a supply of electricity, such as a battery, to operate correctly or optimally.

A typical solution is the inclusion of a battery housed within the accessory device itself for provision of sufficient electrical power to operate the device. Unfortunately, most such batteries are relatively heavy, and are frequently positioned inconveniently, such as along the length of the barrel of the firearm due to the mounting position of the accessory device. Such disadvantageous battery positioning unsettles the desirable neutral balance of the firearm and requires the user to compensate for the additional weight disposed along the barrel when aiming the firearm. As a demonstrative example of the serious consequences of such unsettling, the additional weight of the battery within the accessory may cause the user to miss an intended target when firing, which can be disastrous for the user in a combat situation.

In an attempt to ameliorate the undesirable effect on the neutral balance of the firearm, accessory manufacturers have kept battery sizes small, thereby reducing the overall weight of the accessory. Although smaller batteries lessen the detrimental effect on the neutral balance of the firearm, they do so at the cost of battery life. The smaller, lighter batteries typically have less capacity and cannot provide power for as long a time as a larger, heavier battery. In some cases, especially where the accessory is considered to be essential, and where access to replacement batteries or electricity for recharging the battery is limited or non-existent, heavier batteries with longer life are used despite the detrimental effects on the firearm's balance.

Another related problem with battery operated firearm accessories is that each accessory, as provided by different manufacturers, or even by the same manufacturer, includes circuitry designed to use a supply of electrical power having particular characteristics, such as a specific voltage or current, necessitating a variety of battery configurations. Replacing or recharging the batteries becomes difficult and expensive due to the unique requirements of each accessory device.

Therefore, what is needed is a system for providing electrical power to firearm accessories mounted on a firearm, wherein the system reduces or eliminates undesirable effects on the neutral balance of the firearm, does so without sacrificing battery life, and is capable of providing electrical power of varying characteristics, matching those required by various accessories.

SUMMARY OF THE INVENTION

Briefly described in a preferred embodiment, the present invention overcomes the above-mentioned disadvantages and meets the recognized need for such an invention by providing a system for powering a firearm accessory comprising a power supply included in the firearm, a first positive lead, and a ground lead, wherein the power supply is operably connected to the first positive lead and to the ground lead to provide an electrical potential therebetween.

According to its major aspects and broadly stated, the present invention in its preferred form is a power rail for supplying power to a firearm accessory connected thereto.

More specifically, the preferred embodiment of the present invention is a power supply system comprising at least one positive lead and a ground lead connected to a battery preferably disposed on or in a firearm.

Although the preferred embodiment of the present invention is described as having a main power supply, it is anticipated and considered to be within the scope of the present invention to use alternate or back-up sources of power, such as a separate handle removably attached to the forearm, having a power source electrically connected to the power rail. Backup sources of power may be necessary in some circumstances including, inter alia, if the primary power source voltage falls below a threshold level, or if a fault in the primary power source renders the primary power source unusable.

The at least one positive lead and the ground lead are preferably disposed in a rail. As such, an electric accessory for a firearm may preferably be connected to the rail, and thereby, may receive power from the power supply. Additionally, different voltages may preferably be carried on different positive leads, wherein a selected electronic accessory preferably connects to only an appropriate one of the positive leads.

According to another preferred embodiment, the present invention overcomes the above-mentioned disadvantages and meets the recognized need for such an invention by providing an electrical accessory for attachment to a firearm comprising a first connector for electrically connecting an electrical circuit of the electrical accessory to a first positive lead of the firearm, and a second connector for electrically connecting the electrical circuit to a ground lead of the firearm, wherein the electrical accessory is powered by a power supply of the firearm.

According to its major aspects and broadly stated, the present invention in another preferred form is an electric accessory for a firearm, attachable to a power rail, for supplying power from a power supply of the firearm.

More specifically, the present invention includes an electrical accessory for a firearm comprising a positive connector and a ground connector connected to a positive lead of the firearm and a ground lead of the firearm, respectively. At least one positive lead and the ground lead are preferably disposed in a rail of the firearm. As such, a power supply disposed in or on the firearm may preferably supply power to the electrical accessory. Additionally, different voltages may preferably be carried on different positive leads, and the electronic assembly preferably connects to only an appropriate one of the positive leads.

Accordingly, a feature and advantage of the present invention is its ability to eliminate the need for a battery disposed within the electric accessory.

Still another feature and advantage of the present invention is its ability to maintain a neutral balance of a firearm when an accessory is attached thereto.

Still another feature and advantage of the present invention is its ability to selectively supply a plurality of different voltages to power a corresponding one of a plurality of accessories, each potentially requiring a different voltage.

Still another feature and advantage of the present invention is its ability to enable adjustment of a position of an accessory on a firearm while maintaining a supply of power thereto.

Yet another feature and advantage of the present invention is its ability to provide a power rail comprising a plurality of removable and connectable sections for altering a length of the power rail.

Yet another feature and advantage of the present invention is its ability to be installed on a conventional firearm by replacing conventional components of the firearm.

Yet another feature and advantage of the present invention is its ability to provide a back-up power supply to a battery-powered firearm accessory.

Yet another feature and advantage of the present version of the invention is its ability to recharge a battery-powered firearm accessory.

Yet another feature and advantage of the present invention is its ability to provide a switch on a forearm, grip, stock, or other convenient location, for selectively controlling power supplied to accessories.

Yet a still further feature and advantage of the present invention is its ability to provide a backup or alternate power source in the event a primary power source becomes unusable.

These and other features and advantages of the present version of the invention will become more apparent to one skilled in the art from the following description and claims when read in light of the accompanying drawings.

BRIEF DESCRIPTION OF THE DRAWINGS

The present invention will be better understood by reading the Detailed Description of the Invention with reference to the accompanying drawing figures, in which like reference numerals denote similar structure and refer to like elements throughout, and in which.

DETAILED DESCRIPTION OF THE INVENTION

In describing the present invention, as illustrated in FIGS. 1-7, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
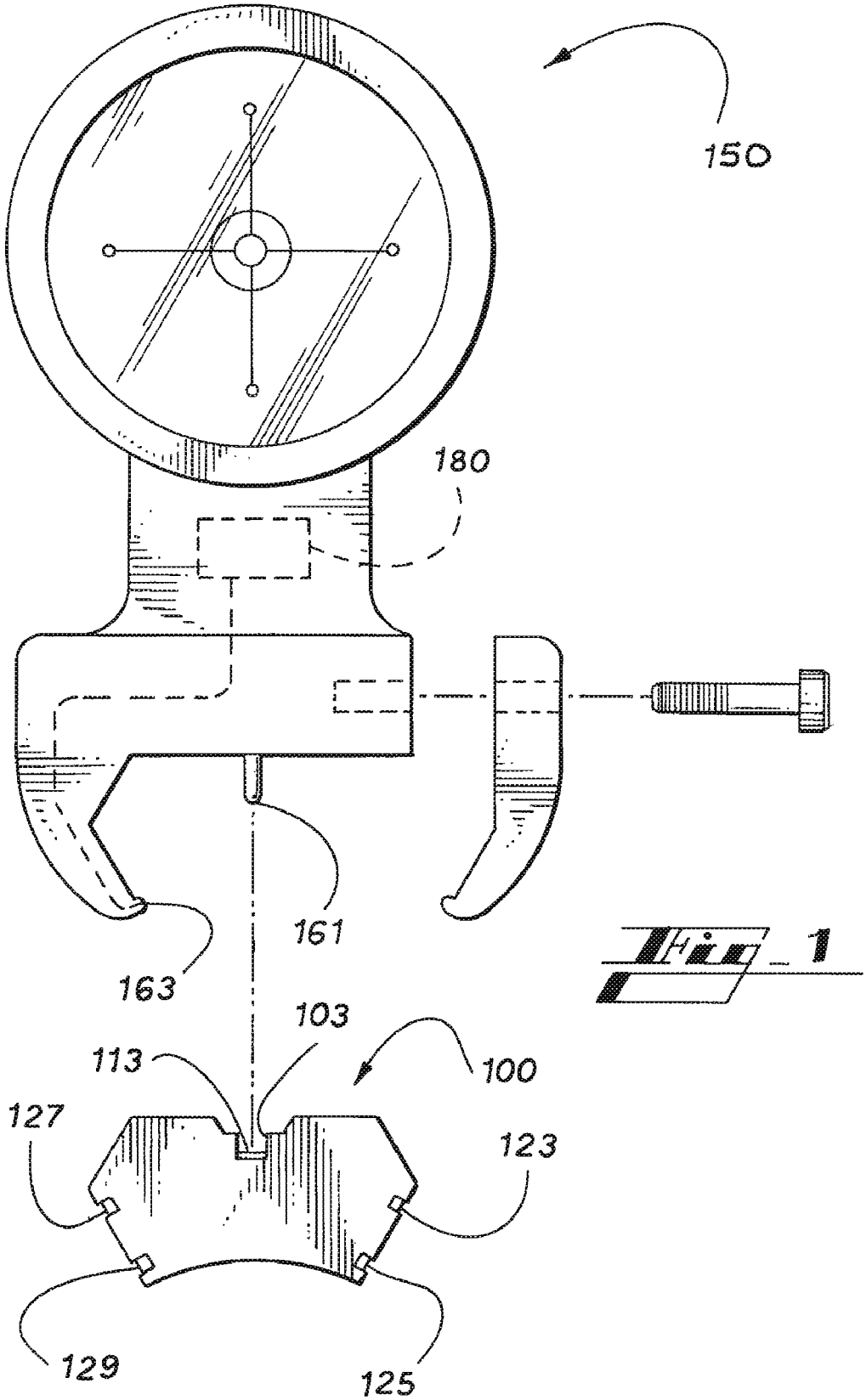
FIG. 1 is a cross-sectional view of a firearm rail according to the present invention.

Referring now to FIG. 1, by way of example, and not limitation, there is illustrated a cross-sectional view of rail 100, including ground lead 113 disposed in channel 103, and positive leads 123, 125, 127, and 129. Rail 100 preferably comprises an electrically insulating material such as plastic, rubber, ceramic, or other suitable material, such that each lead is electrically insulated from the others. Rail 100 may, however, optionally comprise an electrically conductive material such as metal or other suitable material, wherein ground lead 113 may be eliminated and rail 100 may serve as a ground lead. It will be understood by one of ordinary skill in the art that positive leads 123, 125, 127, and 129 may include an external insulation such that each lead is electrically insulated from the others, and from rail 100. Preferably, two or more of positive leads 123, 125, 127, and 129 carry different voltages relative to one another, appropriate for different electric accessories.

In use, electric accessory 150 for a firearm, such as a sight, a scope, or other aiming device or enhancement, a flashlight, an infrared light, or other illumination device, laser, a Tazer, a night-vision apparatus, or any other desired electric accessory, preferably includes first connector 161 for connecting electric circuit 180 of electric accessory 150 to ground lead 113, and second connector 163 for connecting electric circuit 180 of electric accessory 150 to an appropriate one of positive leads 123, 125, 127, and 129. Electric accessory 150 may preferably be removably and/or adjustably mounted on rail 100 such that first connector 161 is electrically connected to ground lead 113, and such that second connector 163 is electrically connected to an appropriate one of positive leads 123, 125, 127, and 129.

Figure 2:
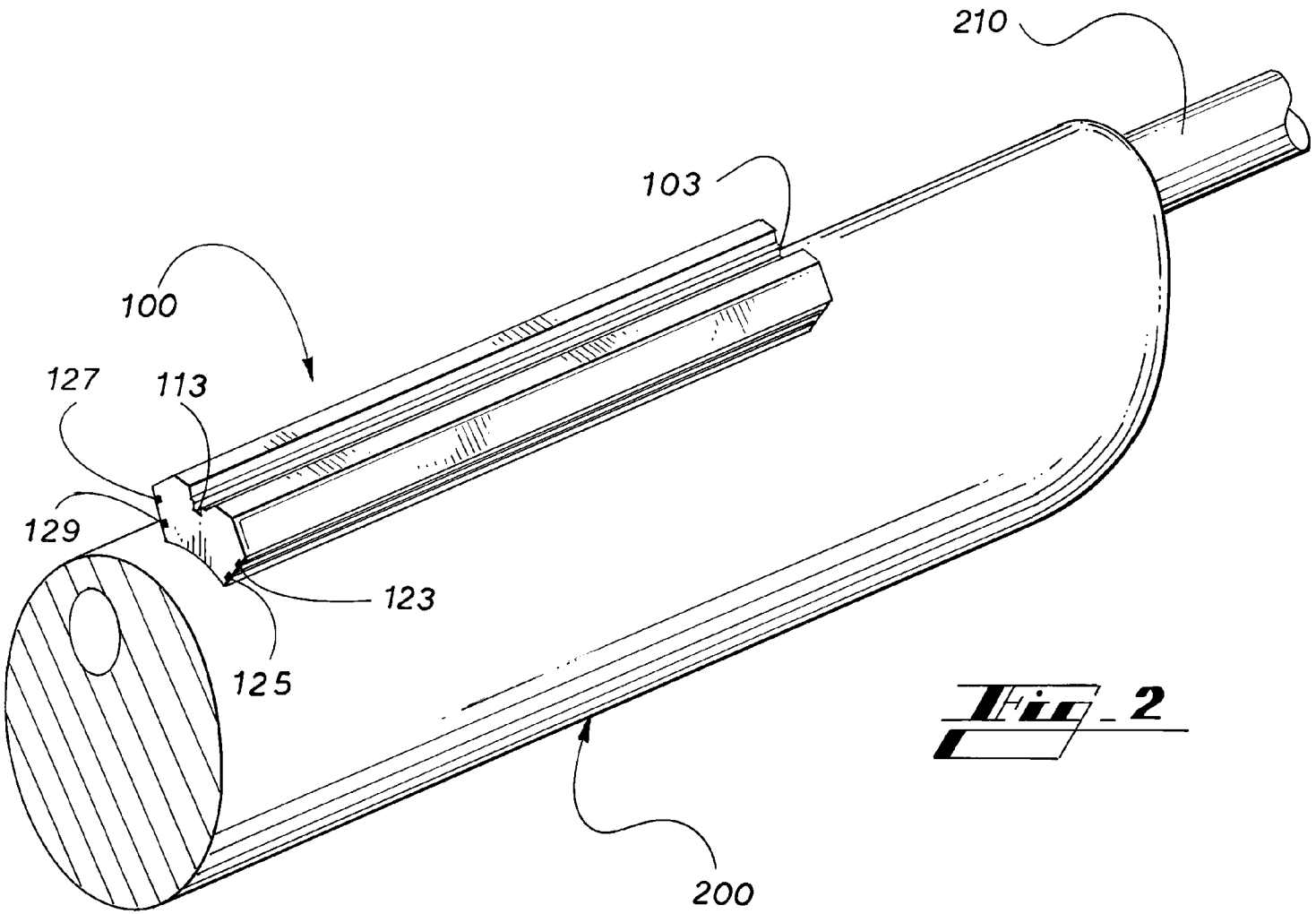
FIG. 2 is a perspective view of the firearm rail of FIG. 1 attached to a forearm.

Now referring to FIG. 2, rail 100 is preferably disposed on top of forearm 200, which may be mounted on barrel 210 of a firearm. As shown, ground lead 113 is accessible from the top of rail 100, and positive leads 123 and 125 are accessible from a side of rail 100.

Figure 3:
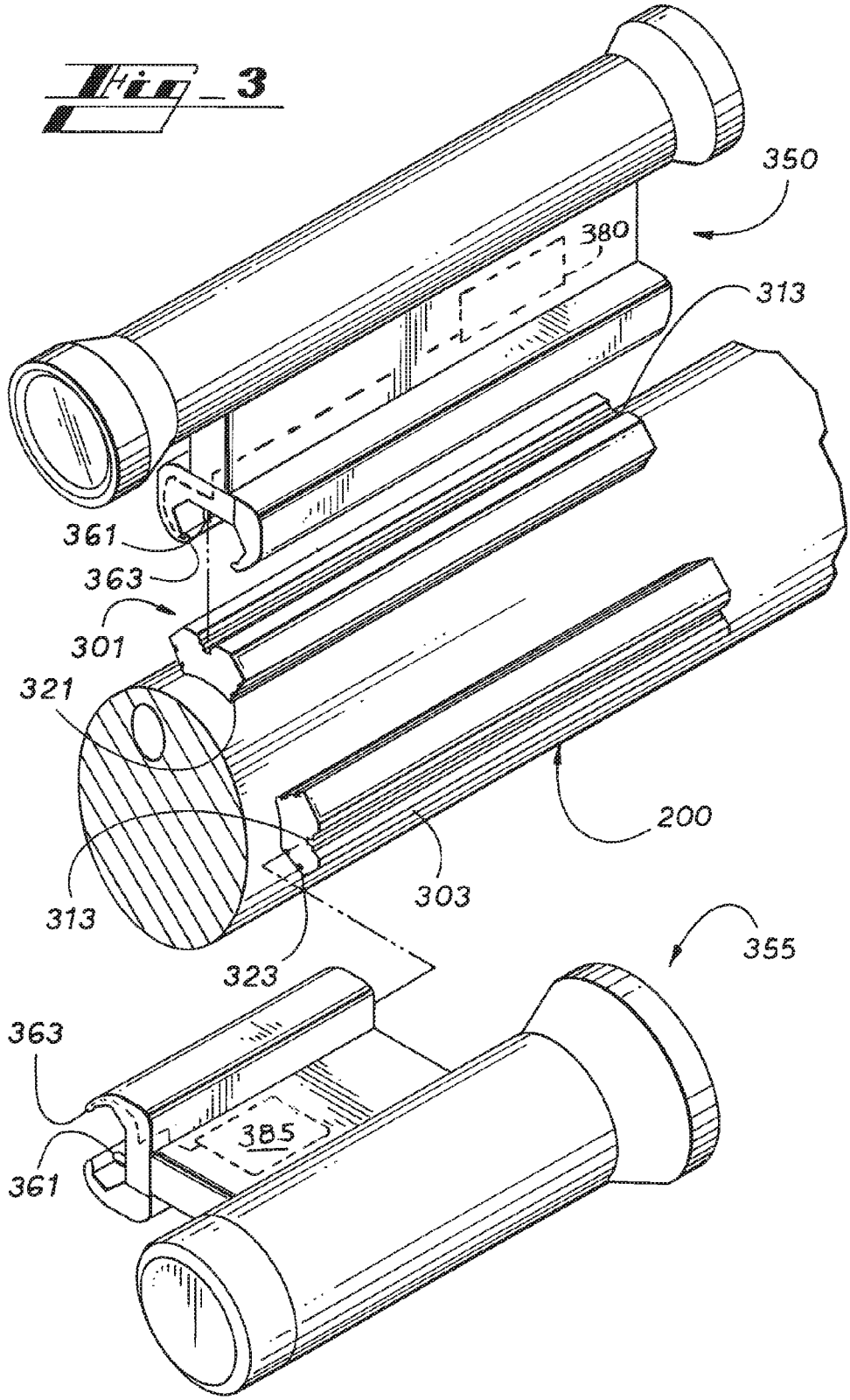
FIG. 3 is a perspective view of a rail system according to an alternative embodiment of the invention.

Now, according to the alternative embodiment of FIG. 3, a plurality of rails 301 and 303 are preferably disposed at different locations on forearm 200. While two rails are shown, it will be apparent to those ordinarily skilled in the art that other numbers of rails, in various configurations, may be provided. In the embodiment of FIG. 3, each of rails 301 and 303 preferably has a ground lead 313, which may optionally be electrically connected to provide a common ground. Preferably, rail 301 further has just one positive lead 321, and rail 303, likewise, preferably has just one positive lead 323. Each of positive leads 321 and 323 is preferably connected to a positive terminal of a power supply, such that a voltage differential exists between positive leads 321 and 323 and ground leads 313. More preferably, positive lead 321 carries a first voltage and positive lead 323 carries a second voltage of a different value. Thus, electric accessories 350 and 355 for a firearm may preferably be mounted to a selected one of rails 301 and 303 according to an appropriate voltage supply required by the electric accessory. Alternatively, however, each of rails 301 and 303 may include a plurality of positive leads, as discussed above with respect to rail 100.

Electric accessories 350 and 355 preferably have respective first connectors 361 and second connectors 363, which are designed to make an electrical connection between ground leads 313 and positive leads 321 and 323, and electronic circuits 380 and 385, respectively, in order to provide power of an appropriate voltage. Each electric accessory attached to the power supply system 400 (described in more detail in FIG. 4 below) of the present invention may have a power switch disposed on the electric accessory for deactivating the individual electric accessory without interrupting or otherwise affecting the power to power supply system 400.

Figure 4:
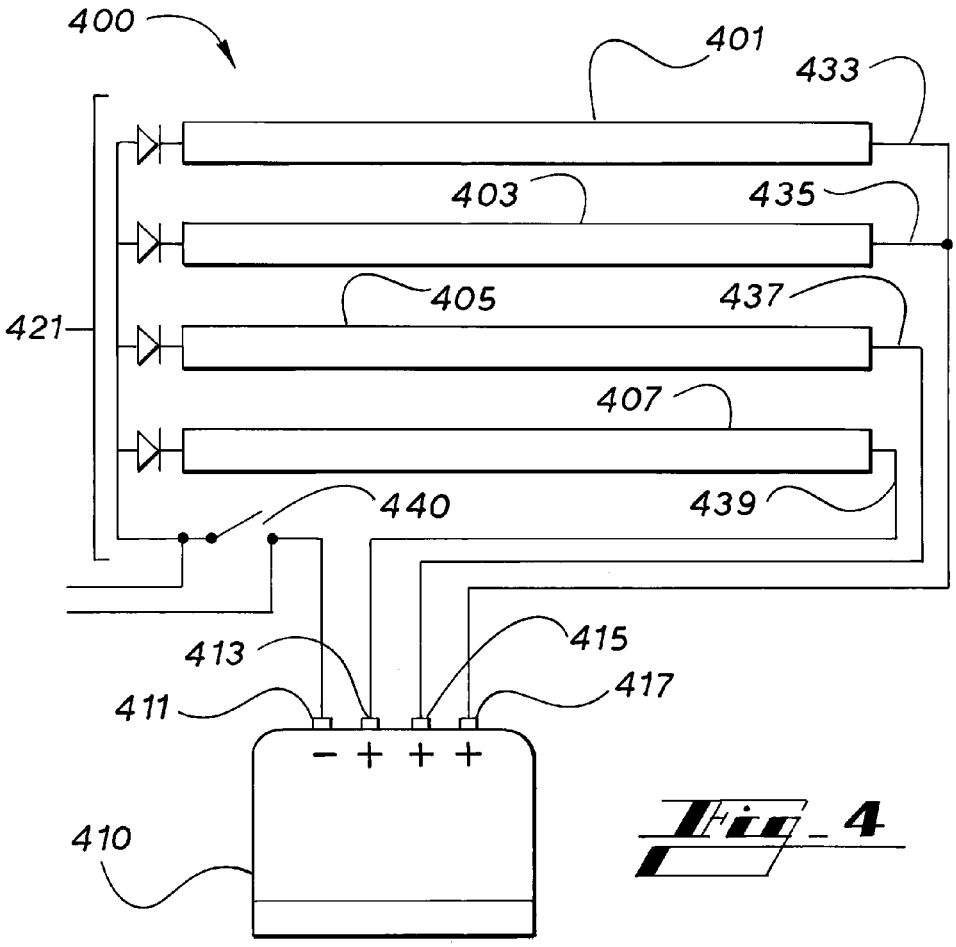
FIG. 4 is a schematic view of a power supply system for powering a firearm accessory according to the present invention.

Now referring to FIG. 4, power supply system 400 preferably includes battery 410, which includes ground terminal 411 and a plurality of positive terminals 413, 415, and 417. Ground terminal 411 is preferably connected to ground lead 421. Each of the plurality of positive terminals 413, 415, and 417 preferably supplies a different voltage, such as +4.5 volts, +6 volts, +9 volts, or other voltage selected to power a particular electric accessory, and is preferably connected to a respective one of positive leads 433, 435, 437, and 439. Positive leads 433, 435, 437 and 439 all share common ground lead 421.

In the preferred embodiment of the present invention, switch 440 may be used to disconnect ground lead 411 from battery 410, and to connect ground lead 411 to an alternative power supply (not shown) should the voltage output of battery 410 be insufficient to maintain proper operation of one or more accessory(ies) connected thereto. Because switch 440 disconnects power from power supply system 400 via ground lead 411, the supply of power to all electric accessories (not shown but illustrated in FIG. 3 above) may be interrupted via a single switch, whereby the complexity of operating multiple switches associated with a respective positive lead or device of the system may be reduced, which may be of vital importance during battle conditions.

It will be understood that power supply system 400 may optionally include variable resistors, solid state components, or other means for altering a voltage available to an accessory. Furthermore, one or more additional or alternative switches may be provided whereby power to one or more selected associated positive lead(s) and/or rail(s) may be controlled.

Figure 5:
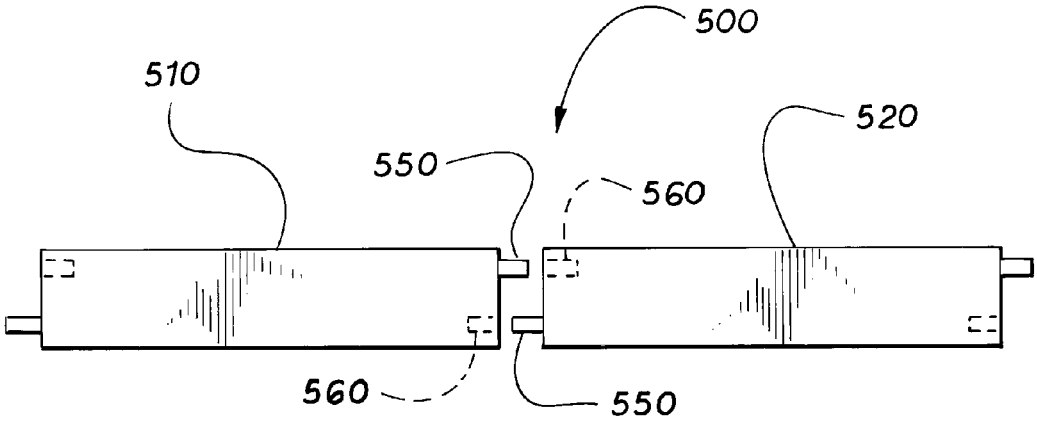
FIG. 5 is a perspective view of a rail system according to an alternative embodiment of the invention.

FIG. 5 illustrates rail 500 according to an alternative configuration. Rail 500 includes a plurality of rail sections 510 and 520. Each of rail sections 510 and 520 may comprise rails, such as rails 100, 301, and 303, and preferably includes male connector 550 and female connector 560. Male connector 550 and female connector 560 preferably enable rail sections 510 and 520 to be combined to form a single rail 500. Thus, a length of rail 500 may be adjusted to fit a particular firearm or a particular application by selective combination of rail sections 510 and 520.

Figures 6, 7:
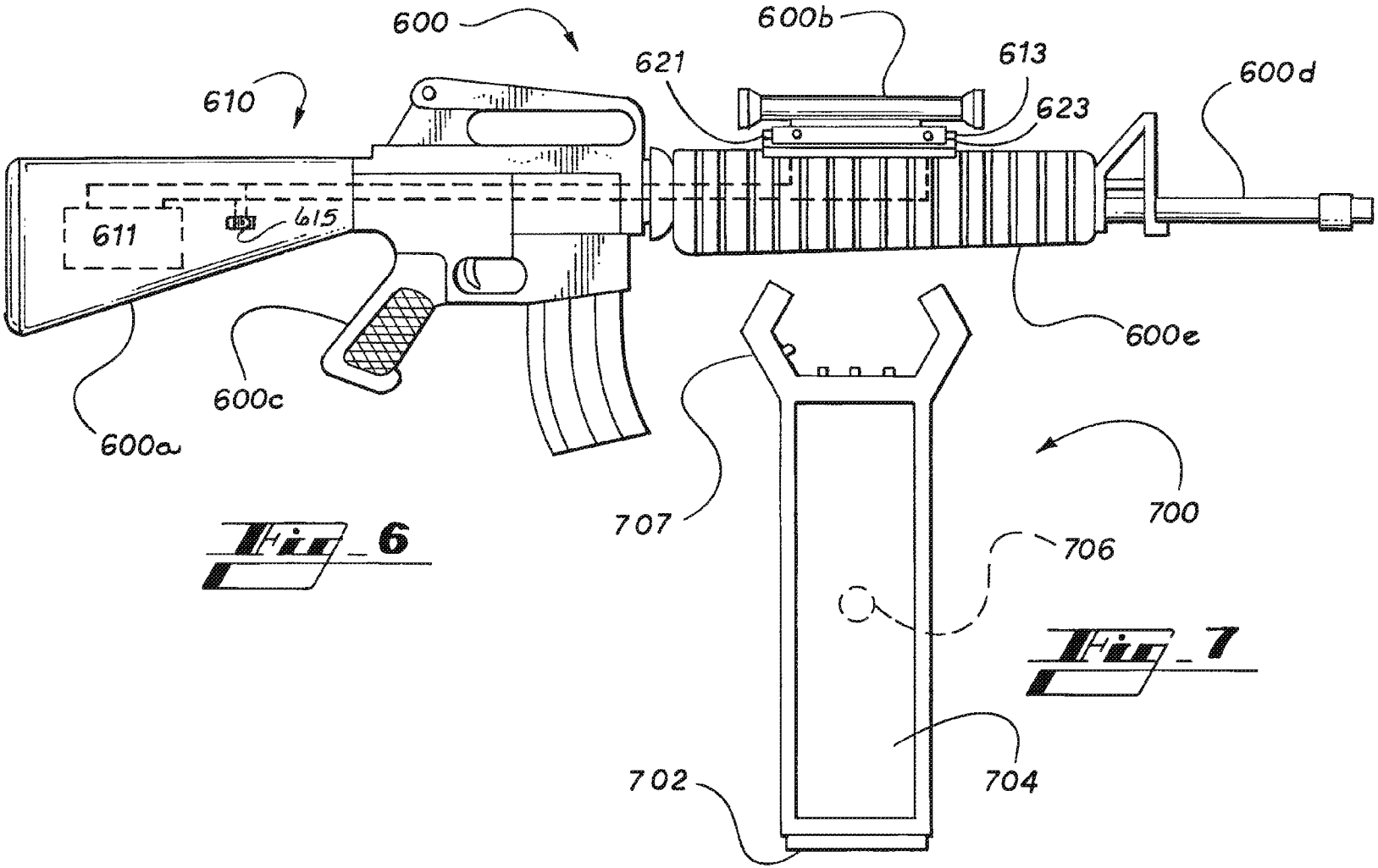
FIG. 6 is a partial cut-away perspective view of a firearm including an accessory power system according to an embodiment of the present invention.
FIG. 7 is a front view of an alternate power source for use with the present invention.

FIG. 6 illustrates firearm 600, such as an M16, an M4, an AR-15, or the like, including power system 610. Multi-tap battery 611 is disposed within stock 600*a* and is electrically connected to electric accessory 600*b* via ground lead 621 and positive lead 623 of rail 613. Alternatively, multi-tap battery 611 may be disposed within grip 600*c*, forearm 600*e*, or within another void of firearm 600, or may be attached to an exterior of stock 600*a*, grip 600*c*, barrel 600*d*, forearm 600*e*, or another convenient part of firearm 600. As will be understood by one ordinarily skilled in the art, other mounting means for the battery may be implemented, including receptacles into which the battery may be inserted and from which it may be ejected, and remote support, such as in or on the clothing or other equipment of a user. Preferably, the location of multi-tap battery 611 is selected such that a balance of firearm 600 is achieved in order to maintain or achieve desirable aiming characteristics.

According to another alternative configuration, firearm 600 may include more than one battery disposed in various locations and providing different voltages, or more than one multi-tap battery disposed in various locations. Furthermore, electric accessory 600*b* may include a battery that may optionally be rechargeable (described more fully with reference to FIG. 7 below), or may rely solely on power system 610 for electric power.

It will also be understood that non-electric accessories may additionally be mounted to rail 613. It will further be understood that switches 615 may be installed near stock 600*a*, grip 600*c*, forearm 600*e*, or at another desired location on firearm 600 to enable selective operation of electric accessory 600*b*. It will further be understood that power system 610 may optionally power non-firearm related accessories, such as communication devices, orienting devices, sensor equipment, computers, or any other electronic device provided with appropriate connectors enabling electrical connection to power system 610.

Referring now to FIG. 7, in an alternate embodiment of the present invention, an alternate power source is provided. More specifically, FIG. 7 shows forearm support 700 having multi-voltage/multi-tap battery 704 disposed therewithin. During normal operation, electrical contacts 707 may be disconnected from power supply system 400. In order to switch from main battery 410 to battery 704, the user may preferably open switch 440 to disconnect battery 410 and may activate switch 706 to connect battery 704 to provide power to power system 400. Battery 704 may readily be inserted or removed, depending upon user preference or operational concerns, by opening and removing battery 704 using operable door 702, which provides access to the inner portion of forearm support 700.

Having thus described exemplary embodiments of the present version of the invention, it should be noted by those ordinarily skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A system for providing power to a firearm accessory, the system comprising:

a plurality of rails attached to a firearm, at least two of the plurality of rails being configured to provide power to the firearm accessory and comprising a positive lead and a ground lead for providing a voltage to the firearm accessory, at least one of the plurality of rails comprising two or more rail sections assembled together to form the at least one of the plurality of rails; and a power supply electrically connected to the plurality of rails, wherein the power supply provides the voltage to the positive lead of each of the at least two of the plurality of rails, wherein the voltage comprises a plurality of voltages, and wherein at least two of the plurality of voltages are different.

2. The system of claim 1, wherein the power supply comprises a battery disposed within a forearm support disposed at a forearm grip of the firearm, and wherein the forearm support comprises electrical contacts for electrically connecting the battery within the forearm support to the plurality of rails.

3. The system of claim 2, wherein the forearm support is removably connected to the firearm at the forearm grip of the firearm.

4. The system of claim 1, wherein at least one of the plurality of rails comprises a plurality of positive leads and the ground lead, wherein each of the plurality of rails provides one of the plurality of voltages, and wherein the firearm accessory is connected to a first of the plurality of rails to provide a first voltage to the firearm accessory and the firearm accessory is connected to a second of the plurality of rails to provide a second voltage to the firearm accessory.

5. The system of claim 1, wherein at least a portion of at least one of the plurality of rails is formed from an electrically insulating material.

6. The system of claim 1, wherein the power supply comprises a battery having a plurality of terminals, each of the plurality of terminals providing one of a plurality of voltages, and wherein at least two of the plurality of voltages are not equivalent to each other.

7. A powered rail assembly comprising:

a plurality of firearm accessory rails connected to a firearm, each of the plurality of firearm accessory rails comprising a positive lead and a ground lead for creating an electrical circuit between the firearm accessory rail and a firearm accessory, at least one of the plurality of rails comprising two or more rail sections assembled together to form the at least one of the plurality of rails;

a forearm support containing a battery electrically connected to the electrical circuit, the battery being configured to power the electrical accessory via the firearm accessory rail, wherein at least one of the plurality of firearm accessory rails is configured to provide a voltage to the firearm accessory, the voltage being provided by the battery wherein the voltage comprises a plurality of voltages, and wherein at least two of the plurality of voltages are not equivalent to each other.

8. The electrical accessory of claim 7, wherein the electrical accessory is removably attached to the firearm, the attachment being adjustable between a plurality of positions on the firearm.

9. The electrical accessory of claim 7, further comprising a switch for selectively connecting the electronic circuit to the power supply of the firearm.

10. A system for providing power to a firearm accessory connected to a firearm, the system comprising:

a plurality of rails attached to a forearm grip of the firearm, each of at least two of the plurality of rails being configured to provide power to the firearm accessory and comprising a positive lead and a ground lead for providing a voltage at each of the at least two of the plurality of rails, wherein the voltage comprises a plurality of voltages, and wherein at least two of the plurality of voltages are not equivalent to each other, and wherein at least one of the plurality of rails comprises two or more rail sections assembled together to form the at least one of the plurality of rails;

a forearm support connected to the forearm grip of the firearm, the forearm support comprising electrical contacts and being configured for use in supporting the firearm; and a power supply electrically connected to the plurality of rails, the power supply comprising a battery disposed within the forearm support connected to the forearm grip of the firearm, the power supply providing one or more of the plurality of voltages to the at least two of the plurality of rails.

11. The system of claim 10, wherein the plurality of firearm accessories comprises a flashlight and a sighting device.

12. The system of claim 10, wherein each of the plurality of firearm accessories has a power switch for turning on and off the plurality of firearm accessories.

13. The system of claim 10, further comprising a power switch for simultaneously turning on and off the plurality of firearm accessories.

* * * * *

UNITED STATES PATENT AND TRADEMARK OFFICE

CERTIFICATE OF CORRECTION

PATENT NO. : 8,151,505 B2
APPLICATION NO. : 11/904999
DATED : April 10, 2012
INVENTOR(S) : John Thompson It is certified that error appears in the above-identified patent and that said Letters Patent is hereby corrected as shown below:

Cover page, item 56 (References Cited, U.S. Patent Documents), please insert:

--2010/0011953 A1 01/2010 Hines--.

Signed and Sealed this
Thirty-first Day of July, 2012

David J. Kappos

David J. Kappos
*Director of the United States Patent and Trademark Office*